US010299614B2

(12) United States Patent
Adams

(10) Patent No.: US 10,299,614 B2
(45) Date of Patent: May 28, 2019

(54) DOOR HOOK

(75) Inventor: William E. Adams, Portersville, PA (US)

(73) Assignee: Adams Mfg. Corp., Portersville, PA (US)

( * ) Notice: Subject to any disclaimer, the term of this patent is extended or adjusted under 35 U.S.C. 154(b) by 1407 days.

(21) Appl. No.: 12/396,971

(22) Filed: Mar. 3, 2009

(65) Prior Publication Data

US 2010/0224747 A1 Sep. 9, 2010

(51) Int. Cl.
*A47G 25/06* (2006.01)
*G09F 7/18* (2006.01)

(52) U.S. Cl.
CPC ..... *A47G 25/0614* (2013.01); *G09F 7/18* (2013.01)

(58) Field of Classification Search
USPC ..... 248/215, 301, 304
See application file for complete search history.

(56) References Cited

U.S. PATENT DOCUMENTS 361,634 A * 4/1887 Judd ..... 248/215
448,224 A * 3/1891 Glover ..... 29/7
815,813 A * 3/1906 Graham ..... 248/262
1,441,913 A * 1/1923 Darling ..... D06F 57/12 15/264
2,080,990 A * 5/1937 Weekley ..... 248/215
2,425,629 A * 8/1947 Mayer ..... 224/561
2,429,586 A * 10/1947 Rompre ..... 248/248
2,436,533 A * 2/1948 Thompson ..... 248/301
D159,261 S * 7/1950 Fiechter ..... D6/323
2,661,098 A * 12/1953 Wannop ..... 211/106.01
D206,232 S * 11/1966 Magnuson, III ..... D6/323
3,598,248 A * 8/1971 Black ..... 211/106
3,907,118 A 9/1975 Pelavin
4,203,175 A * 5/1980 Heine ..... A47C 21/00 211/34
D275,917 S 10/1984 Einhorn
D279,450 S * 7/1985 Chap ..... D6/325
D281,575 S * 12/1985 Chap ..... D6/325
D322,361 S * 12/1991 Goodman et al. ..... D6/323
5,085,387 A * 2/1992 Peterson et al. ..... 248/154
5,158,186 A 10/1992 Krut
D335,815 S * 5/1993 Sachs ..... D8/363
D342,889 S 1/1994 Adams
D345,096 S 3/1994 Shapiro
D353,992 S * 1/1995 Dombrowski et al. ..... D8/373
5,413,297 A 5/1995 Adams
D360,355 S 7/1995 Adams
(Continued)

FOREIGN PATENT DOCUMENTS

GB 186407 9/1922

*Primary Examiner* — Jonathan Liu
(74) *Attorney, Agent, or Firm* — Buchanan Ingersoll & Rooney PC

(57) ABSTRACT

A door hook includes a top member, a back member, a front member, a hook and a leg. The back member is attached to the first end of the top member and the front member is attached to the opposite end of the top member. The leg and hook are also attached to the front member. The leg extends below the hook. A resilient foot is attached to the leg such that the resilient foot is below the hook. The front member is configured to flex into a generally convex shape after a downward force acts on the hook and the resilient foot is configured to flex after the downward force is exerted on the hook.

19 Claims, 7 Drawing Sheets

(56) References Cited

U.S. PATENT DOCUMENTS

| | | | | | |
|---|---|---|---|---|---|
| D360,572 | S | | 7/1995 | Adams | |
| D365,015 | S | * | 12/1995 | Avinger | D8/373 |
| 5,535,971 | A | | 7/1996 | Adams | |
| 5,607,131 | A | | 3/1997 | Adams | |
| D393,970 | S | | 5/1998 | Lee | |
| D411,436 | S | * | 6/1999 | Krehel | D6/327 |
| 6,032,842 | A | * | 3/2000 | Brickner | 224/560 |
| D429,999 | S | * | 8/2000 | Swolsky | D8/372 |
| 6,311,851 | B1 | * | 11/2001 | Knudsen et al. | 211/13.1 |
| 6,364,260 | B1 | * | 4/2002 | Lorincz et al. | 248/215 |
| D479,981 | S | * | 9/2003 | Snell | D8/372 |
| D482,557 | S | * | 11/2003 | Shih | D6/553 |
| D483,653 | S | | 12/2003 | Immerman | |
| D484,394 | S | * | 12/2003 | Marcus | D8/372 |
| D493,698 | S | * | 8/2004 | Goodman | D8/367 |
| 6,854,610 | B2 | | 2/2005 | Adams | |
| 7,185,864 | B2 | | 3/2007 | Adams | |
| 7,207,088 | B2 | | 4/2007 | Adams et al. | |
| D549,083 | S | * | 8/2007 | Barnett et al. | D8/373 |
| D577,508 | S | * | 9/2008 | Derocher et al. | D6/407 |
| 7,887,017 | B2 | * | 2/2011 | Moran | 248/339 |
| 2002/0104937 | A1 | * | 8/2002 | Avinger | 248/215 |
| 2005/0236537 | A1 | * | 10/2005 | Jackson | 248/205.3 |
| 2007/0246628 | A1 | * | 10/2007 | Palmer | 248/304 |

* cited by examiner

DOOR HOOK

FIELD OF THE INVENTION

The present invention is related to door hooks.

BACKGROUND OF THE INVENTION

There are a variety of hooks that fit over the top of a door. One common type of hook has a U-shaped bracket having an opening not greater than the width of the door hook to which it is to be attached. One or more hooks extend from either or both sides of the bracket. Examples of door hooks are disclosed in U.S. Pat. Nos. 7,207,088, 7,185,864, 6,854,610, 6,311,851, 6,302,365, 5,607,131, 5,553,823, 5,413,297, 5,158,186, 4,817,239, and 3,907,118, and U.S. Design Pat. Nos. D549,083, D455,947, D422,198, D393,970, D374,168, D360,572, D360,355, D345,096, D342,889, D326,021, and D275,917. These door hooks are typically made of plastic or metal and are usually unitary structures.

In designing an over-the-door hook, the objective has always been to create an inexpensive hook that will fit the door while that door is open or closed and that will hold significant weight. Plastic is often used for many of the over-the-door hooks being sold, particularly those sold for hanging wreaths and other holiday decorations. However, the weight of the object being hung often causes the hook to laterally move or sway when the door is opened or closed and when the object is initially placed on the hook. If a wreath is hung on the outside of a door on a conventional U-shaped hook, the wind may cause the wreath to move laterally or swing like a pendulum. Such swaying can cause the wreath or other object to fall from the hook. Further, the swinging object or hook can scratch or otherwise mar the door when swinging back and forth. This damage is a significant problem for those who live in windy areas.

U.S. Pat. No. 5,158,186 discloses the use of a bumper that has a box-like structure to prevent a door hanging file system from contacting a door surface. The bumper is a rigid box-like structure that is affixed to rails in the file system and also affixed to the door. The bumper spaces the rails of a door hanging support or file system from contacting the vertical surface of the door.

Such a bumper system is impractical for many door hook applications because users prefer to easily remove door hooks without using tools or time consuming removal steps. This is particularly true for door hooks that are designed for being temporarily positioned on a door for a holiday season to hold a decoration, such as the hook disclosed in U.S. Design Pat. No. D360,355.

There is a need for an over-the-door hook that can hold significant weight when the door is open or closed and which permits the door to be moved without damaging the door or causing the hook to laterally sway. Such a hook must also stay in place when exposed to windy conditions. Preferably, the door hook is easily mounted and unmounted from a door.

SUMMARY OF THE INVENTION

A door hook is provided that includes a top member, a back member and a front member. The top member has a first end and a second end opposite the first end. The back member is attached to the first end of the top member and the front member is attached to the second end of the top member forming a U-shape. The front member extends below the top member and is resilient. A hook is attached to the front member and a leg extends from the front member below at least a portion of the hook. A resilient foot is attached to the leg such that the resilient foot is below the hook. The front member is configured to flex into a generally convex shape after a downward force acts on the hook and the resilient foot is configured to flex after the downward force is exerted on the hook.

Preferably, the resilient foot is composed of a soft durometer material or an elastomeric material and the front member and leg are composed of a polymeric material such as plastic. In one embodiment of my door hook, the leg and front member are integrally molded as a unitary structure composed of polycarbonate. Preferably, the top member, back member, front member, hook and leg are integrally molded as a unitary structure.

In some embodiments of my door hook, the back member may extend below the top member at an angle of 80° to 85° relative to the lop member. The front member may extend at an angle of 85° to 90° relative to the top member. A rib may also be attached to the front member. The leg may be attached to both the front member and the hook.

In one embodiment of my door hook, the resilient foot includes a body that has a first side and a second side opposite the first side. A first projection extends from the first side and a second projection extends from the second side. The first and second projections flex after a downward force acts on the hook of the door hook. The body of the resilient foot may include an opening sized and configured to receive a portion of the leg to attach the resilient foot to the leg.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of my door hook are shown in the accompanying drawings and certain present preferred methods of practicing the same are also illustrated therein.

DETAILED DESCRIPTION OF PRESENT PREFERRED EMBODIMENTS

Figure 1:
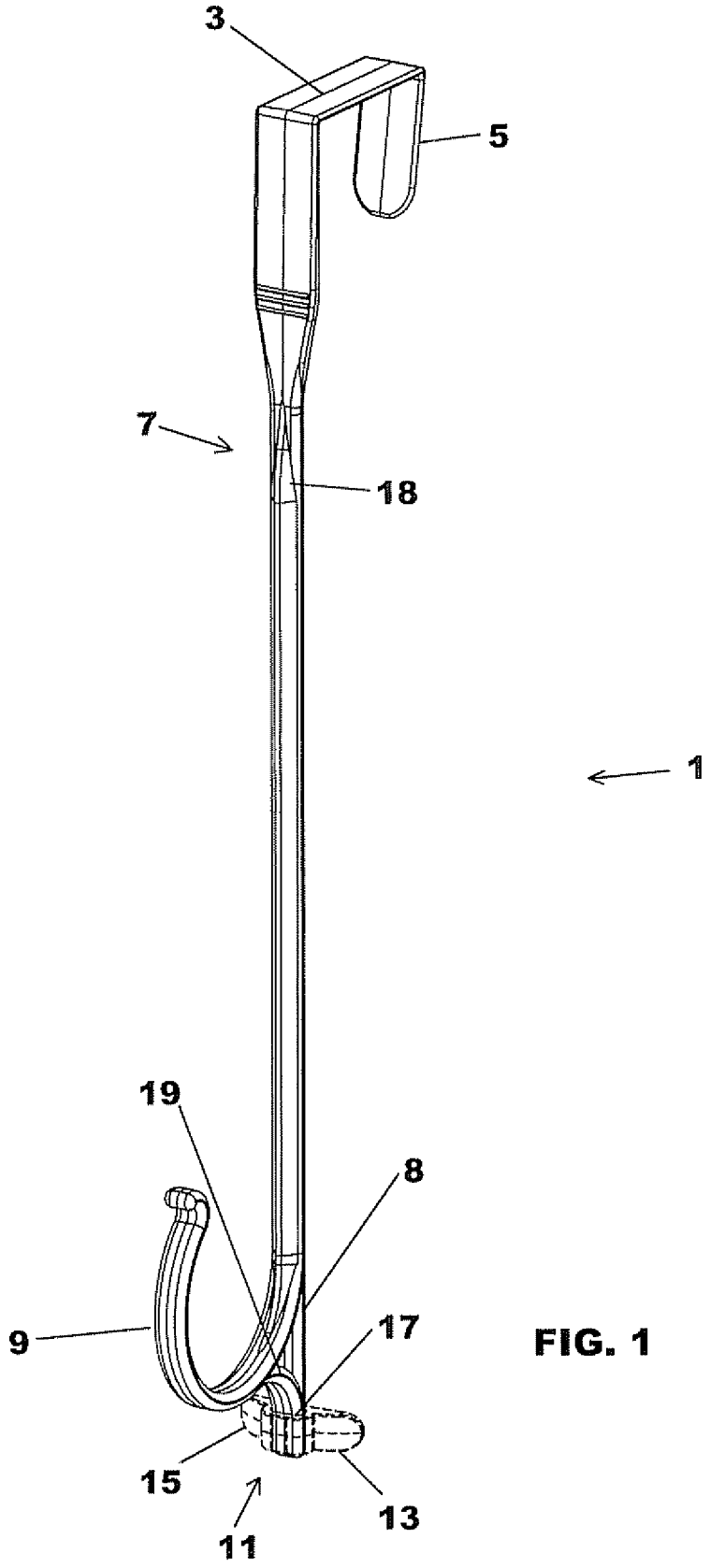
FIG. 1 is a perspective view of a first present preferred embodiment of my door hook.
Figure 2:
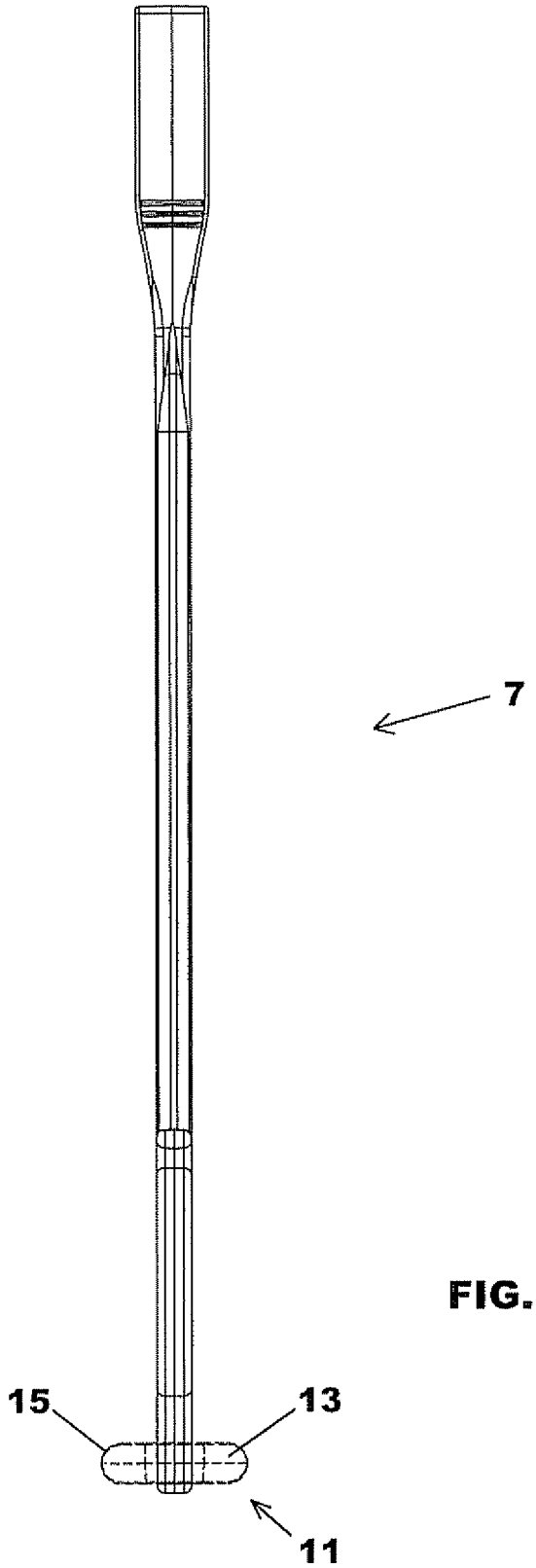
FIG. 2 is a front view of the first present preferred embodiment of my door hook.
Figure 3:
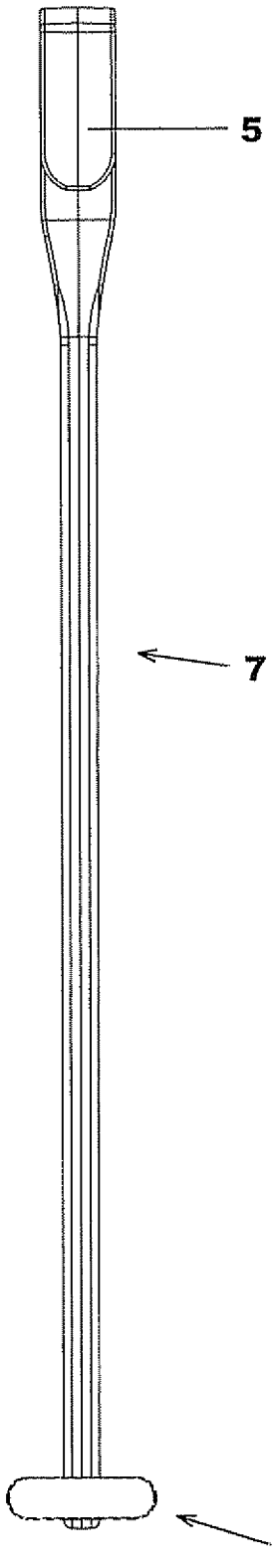
FIG. 3 is a back view of the first present preferred embodiment of my door hook.
Figure 4:
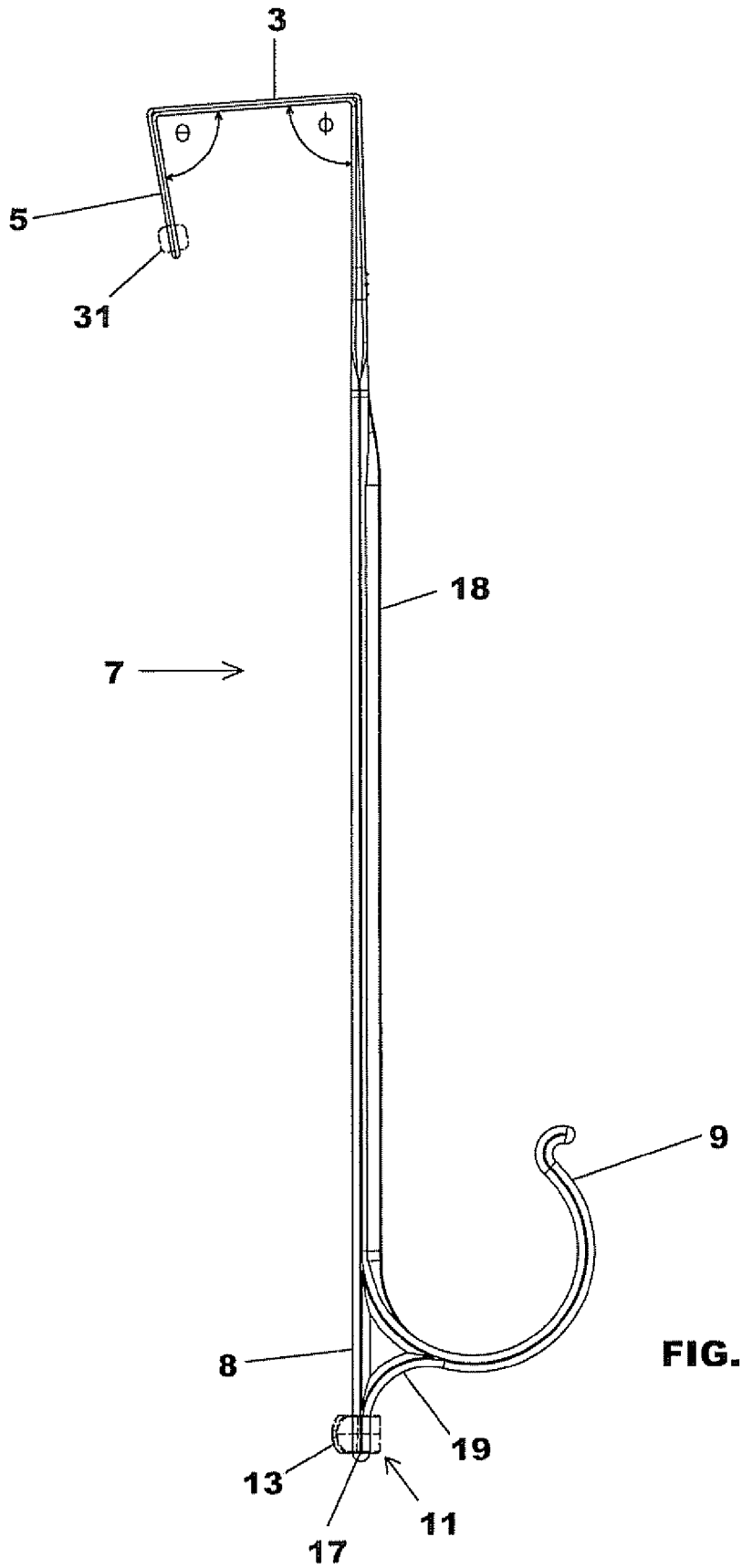
FIG. 4 is a right side view of the first present preferred embodiment of my door hook.

A first present preferred embodiment 1 of my door hook is illustrated in FIGS. 1-6. The door hook 1 includes a top member 3 that has a rear end attached to a back member 5. The front end of the top member 3 is attached to a front member 7. The front member 7 is attached to the front end of the top member 3 such that the front member 7 extends linearly below the top member 3. The front member 7 preferably extends below the top member 3 at an angle φ of between 85° and 90° relative to the top member 3. The back member 5 extends below the top member 3 at an angle Θ of between 80° and 85° relative to the top member 3. A hook 9 is attached to the front member 7 at the bottom end of the front member 7. A leg 8 is also attached to the bottom end of the front member 7. The leg 8 extends below the hook 9. In a preferred embodiment, the leg is 1.25 inches. However, the length could be somewhat shorter or longer.

Preferably, the leg 8 also includes a brace 19 that is attached between the leg and the hook 9. I have found that the brace increases the bending distance and reduced the contact area with the door. In one embodiment with the brace, the peak of the curve defined by the flexed front member was 0.78 inches when a wreath was hung on the door hook. Without the brace, the peak was 0.72 inches from the door and a greater portion of the wreath hook was in contact with the door. Without the brace, 0.8 inches of the top portion of the door hook were in contact with the door. With the brace, 0.76 inches of the top of the door hook were in contact with the door.

Figure 7:
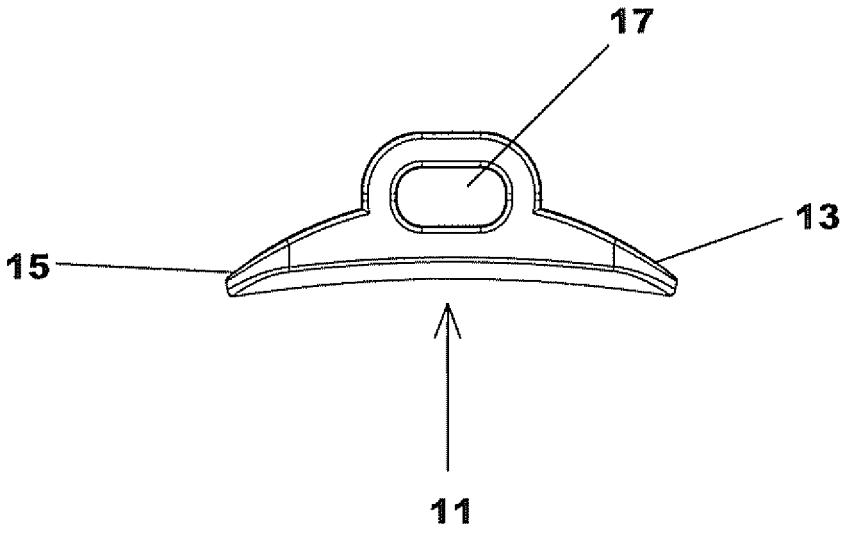
FIG. 7 is a top view of a first present preferred resilient foot.

A resilient foot 11 is attached to the leg 8 at a position below at least a portion of the hook 9. As may be best appreciated from FIG. 7, the resilient foot 11 includes a body that defines an opening 17. A first projection 13 extends from one side of the body and a second projection 15 extends from the other side of the body of the resilient foot 11. The opening 17 is sized and configured to receive a portion of the leg 8 for attaching the resilient foot 11 to the leg 8. The leg 8 may also include small protrusions or bumps (not shown) to help keep the leg 8 retained within the opening 17 of the resilient foot 11. One may provide a second resilient foot 31 on the back member 5 as shown in dotted line in FIG. 4.

The resilient foot 11 is preferably composed of a material that is soft relative to wood or other door materials so the resilient foot 11 does not scratch or otherwise mar the door when an object is placed on the hook 9 of the door hook 1 or the door is moved. The material of the resilient foot 11 also preferably has a high static coefficient of friction. For instance, the resilient foot 11 can be composed of an elastomeric material or soft material having a durometer of from 30 to 150. Preferably, the resilient foot is composed of soft vinyl, soft rubber, sanoprene or other soft material.

The front member 7 may include one or more ribs 18. Each rib 18 can provide additional strength to the front member. Preferably, the one or more ribs 18 are integral with the front member.

The top member 3, back member 5, front member 7, hook 9 and leg 8 may be integrally molded as a unitary structure composed of a polymeric material such as plastic. For instance, the top member 3, back member 5, front member 7, leg 8 and hook 9 may be injection molded as a unitary structure. The top member 3, back member 5, front member 7, hook 9 and leg 8 are preferably be composed of polycarbonate or ABS.

It should be appreciated that the hook 9 of the door hook is sized and configured to hold objects. Preferably, the hook 9 is sized and configured to hold decorations such as wreaths, holiday dolls, figurines, or signs.

Figure 5:
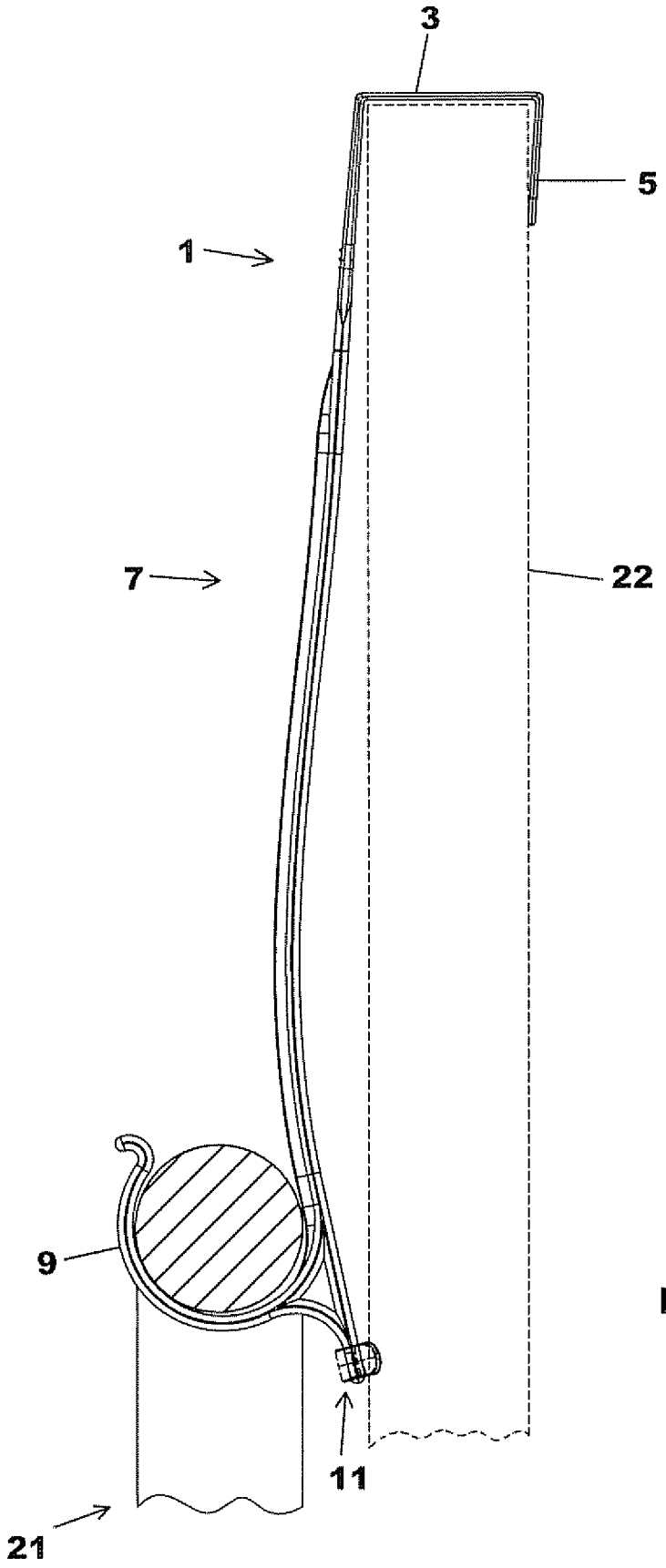
FIG. 5 is a left side view of the first present preferred embodiment hung on a door shown in dotted line with a wreath on the hook causing the front member of the door hook to flex forming a convex shape.
Figure 6:
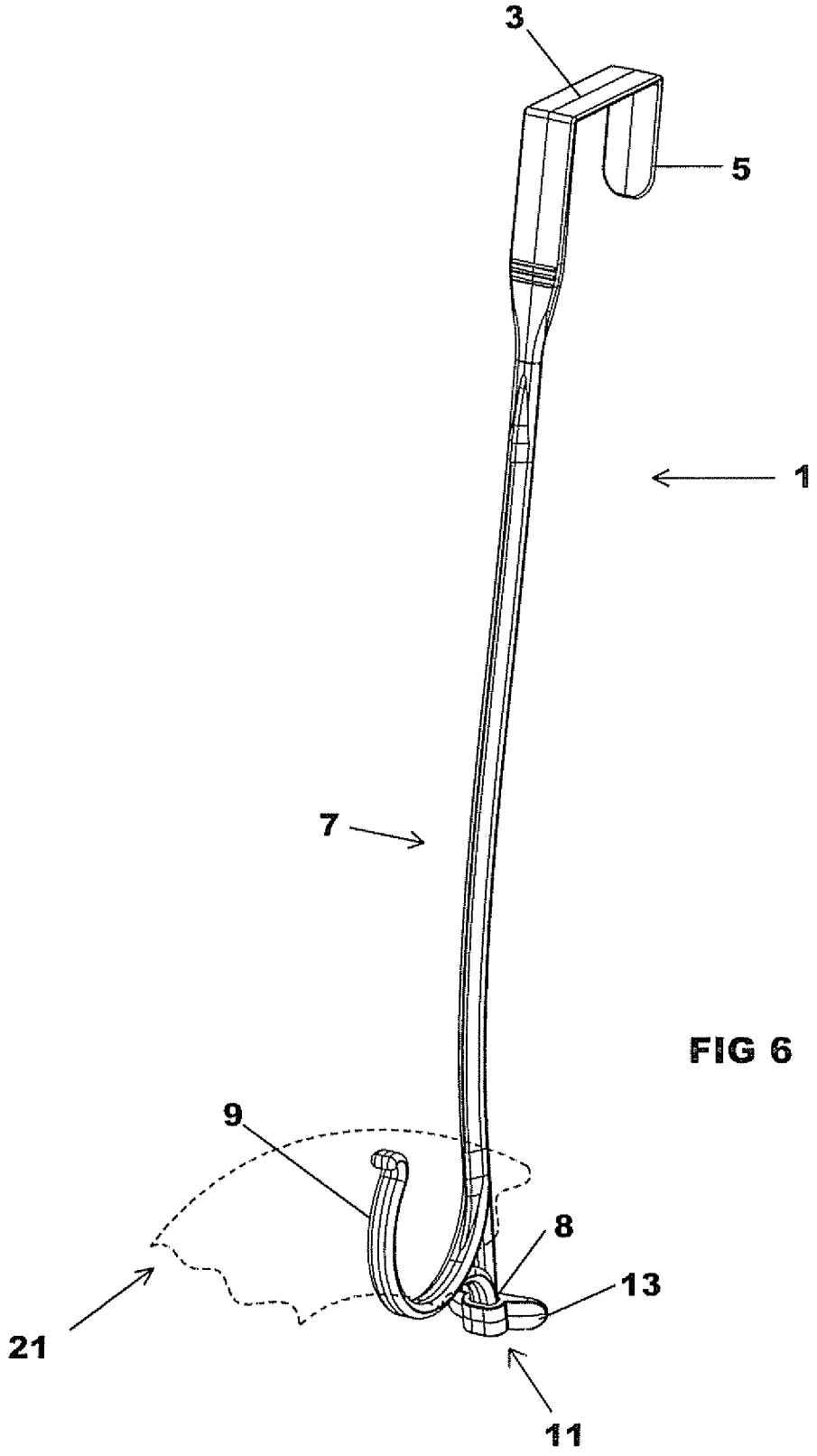
FIG. 6 is a perspective view of the first present preferred embodiment holding a wreath as shown in FIG. 5.

The door hook 1 is sized and configured so that when the hook 9 is holding an object 21, the front member 7 flexes into a convex shape, as may be seen in FIGS. 5 and 6. The convex shape of the door front member 7 causes a significant portion of the weight of the object 21 to provide a holding force that acts on the resilient foot 11. The projections 13 and 15 of the resilient foot 11 are configured to bend after the object is placed on the hook 9 so that resilient foot 11 presses against a door 22 on which the door hook 1 is hung.

It should be appreciated that the downward force provided by the weight of the wreath 21 is at least partially transferred as a holding force that acts against the resilient foot 11. The holding force causes the resilient foot 11 to significantly press against the door from which the door hook 1 is hung. Because the point of contact with the door is below the hook, the foot reduces or prevents the door hook 1 from laterally moving or swinging when the door is opened or closed. Of course, the friction property of the resilient foot 11 also helps reduce or stop the front member 7 from swinging or otherwise move laterally from movement of the door.

I have compared the door hook shown in the drawings to conventional door hooks when a wreath is hung on both hooks. I found that a greater lateral force acting on the wreath was required to move the wreath hung on the door hook here disclosed than is required to move the wreath on a conventional door hook such as the hook disclosed in U.S. Pat. No. 5,413,297. Additionally, the leg decreases the area of contact between the door and the door hook. Consequently, if the door hook is moved, far less damage, if any, can occur than occurs with a conventional door hook rubbing repeatedly against the door surface.

While certain present preferred embodiments of my door hook and certain embodiments of methods of practicing the same have been shown and described, it is to be distinctly understood that the invention is not limited thereto but may be otherwise variously embodied and practiced within the scope of the following claims.

I claim:

1. A door hook comprising:

a top member having a first end and a second end;

a back member having a first end and a second end, the first end of the back member attached to the first end of the top member;

a front member having a first end and a second end, the first end of the front member attached to the second end of the top member such that the front member extends below the top member; the front member being resilient;

a hook having a first end and a second end, the first end of the hook attached to the front member adjacent the second end of the front member and the second end of the hook being a free end;

a leg attached directly to the second end of the front member, the leg extending below the hook;

a resilient foot attached to the leg such that the resilient foot is below the hook; and wherein the front member is made of a material and shape that allows the front member to flex into a generally convex shape when a downward force acts on the hook.

2. The door hook of claim 1 wherein the resilient foot is composed of material having a durometer of from 30 to 150 or is an elastomeric material.

3. The door hook of claim 1 further comprising at least one rib attached to the front member.

4. The door hook of claim 1 wherein the back member extends below the top member at an angle of 80° to 85° relative to the top member.

5. The door hook of claim 1 wherein the door hook is composed of at least one polymeric material.

6. The door hook of claim 1 wherein the front member extends at an angle of 85° to 90° relative to the top member.

7. The door hook of claim 1 wherein the leg and the front member are integrally molded as a unitary structure.

8. The door hook of claim 1 wherein the resilient foot is composed of a first material and the front member is composed of a second material that is different from the first material.

9. The door hook of claim 1 wherein the front member linearly extends below the top member.

10. The door hook of claim 1 wherein the top member, back member, front member, hook and leg are integrally molded as a unitary structure.

11. The door hook of claim 1 wherein the leg is also attached to the hook.

12. A door hook comprising:

a top member having a first end and a second end;

a back member having a first end and a second end, the first end of the back member attached to the first end of the top member;

a front member having a first end and a second end, the first end of the front member attached to the second end of the top member such that the front member extends below the top member; the front member being resilient;

a hook having a first end and a second end, the first end of the hook attached to the front member adjacent the second end of the front member and the second end of the hook being a free end;

a leg attached directly to the second end of the front member, the leg extending below the hook;

a resilient foot attached to the leg such that the resilient foot is below the hook;

wherein the front member is made of a material and shape that allows the front member to flex into a generally convex shape when a downward force acts on the hook;

wherein the resilient foot is comprised of a body having a first side and a second side opposite the first side, a first projection extending from the first side of the body and a second projection extending from the second side of the body, the first and second projections flexing when the downward force acts on the hook.

13. The door hook of claim 12 wherein the body has an opening formed therein that is sized and configured to receive a portion of the leg to attach the resilient foot to the leg.

14. A door hook comprising:

a top member having a first end and a second end;

a back member having a first end and a second end, the first end of the back member attached to the first end of the top member;

a front member having a first end and a second end, the first end of the front member attached to the second end of the top member such that the front member extends below the top member; the front member being resilient;

a hook having a first end and a second end, the first end of the hook attached to the front member adjacent the second end of the front member and the second end of the hook being a free end;

a leg attached directly to the second end of the front member, the leg extending below the hook; the leg, the hook, the front member, the back member and the top member being integrally molded as a unitary structure composed of plastic;

a resilient foot attached to the leg such that the resilient foot is below the hook; and wherein the front member is made of a material and shape that allows the front member to flex into a generally convex shape when a downward force acts on the hook.

15. The door hook of claim 14 further comprising at least one rib attached to the front member.

16. The door hook of claim 14 wherein the resilient foot is composed of a first material and the hook, front member, top member, back member and leg are composed of a second material that is different than the first material.

17. The door hook of claim 16 wherein the first material has a durometer of from 30 to 150 or is an elastomeric material and the second material is a plastic.

18. A door hook comprising:

a top member having a first end and a second end;

a back member having a first end and a second end, the first end of the back member attached to the first end of the top member;

a front member having a first end and a second end, the first end of the front member attached to the second end of the top member such that the front member extends below the top member; the front member being resilient;

a hook having a first end and a second end, the first end of the hook attached to the front member adjacent the second end of the front member and the second end of the hook being a free end;

a leg attached directly to the second end of the front member, the leg extending below the hook; the leg, the hook, the front member, the back member and the top member being integrally molded as a unitary structure composed of plastic;

a resilient foot attached to the leg such that the resilient foot is below the hook; and wherein the front member is made of a material and shape that allows the front member to flex into a generally convex shape when a downward force acts on the hook; and wherein the resilient foot is comprised of a body having a first side and a second side opposite the first side, a first projection extending from the first side of the body and a second projection extending from the second side of the body, the first and second projections flexing when the downward force acts on the hook.

19. The door hook of claim 18 wherein the body has an opening formed herein that is sized and configured to receive a portion of the leg to attach the resilient foot to the leg.

* * * * *